US011390069B2

(12) United States Patent
Sang et al.

(10) Patent No.: US 11,390,069 B2
(45) Date of Patent: Jul. 19, 2022

(54) SEAL PRINTER

(71) Applicant: HAIMING UNITED ENERGY GROUP JUWANG TECHNOLOGY CO., LTD., Tangshan (CN)

(72) Inventors: Haiming Sang, Tangshan (CN); Ge Gan, Tangshan (CN); Song Li, Tangshan (CN)

(73) Assignee: HAIMING UNITED ENERGY GROUP JUWANG TECHNOLOGY CO., LTD., Tangshan (CN)

( * ) Notice: Subject to any disclaimer, the term of this patent is extended or adjusted under 35 U.S.C. 154(b) by 182 days.

(21) Appl. No.: 17/009,721

(22) Filed: Sep. 1, 2020

(65) Prior Publication Data

US 2021/0187942 A1 Jun. 24, 2021

(30) Foreign Application Priority Data

Jul. 2, 2019 (CN) ..... 201910588837.5

(51) Int. Cl.

| | |
|---|---|
| ***B41J 2/175*** | (2006.01) |
| ***B41J 2/045*** | (2006.01) |
| ***B41J 3/36*** | (2006.01) |
| ***B41J 3/54*** | (2006.01) |

(52) U.S. Cl.

CPC ..... *B41J 2/04501* (2013.01); *B41J 2/1752* (2013.01); *B41J 2/17553* (2013.01); *B41J 2/17559* (2013.01); *B41J 3/36* (2013.01); *B41J 3/54* (2013.01)

(58) Field of Classification Search

CPC .... B41J 2/04501; B41J 2/175; B41J 2/17503; B41J 2/17509; B41J 2/1752; B41J 2/17553; B41J 2/17559; B41J 3/36; B41J 3/54; B41J 29/02

See application file for complete search history.

(56) References Cited

U.S. PATENT DOCUMENTS

2017/0028756 A1* 2/2017 Koshigoe ..... B65D 15/22
2017/0080725 A1* 3/2017 Obara ..... B41J 29/02

FOREIGN PATENT DOCUMENTS

| | | | |
|---|---|---|---|
| CN | 202836967 | U | 3/2013 |
| CN | 204586158 | U | 8/2015 |
| CN | 107504995 | A | 12/2017 |
| CN | 207972423 | U | 10/2018 |

OTHER PUBLICATIONS

Office Action in corresponding Chinese Patent Application No. 201910588837.5, dated Dec. 10, 2019.

* cited by examiner

*Primary Examiner* — Anh T Vo

(74) *Attorney, Agent, or Firm* — Marshall, Gerstein & Borun LLP

(57) ABSTRACT

A seal printer is provided, which performs printing by driving a nozzle to rotate through a motor in a printer shell, reduces a number of parts in the printer and a volume of the printer is similar to a volume of a traditional seal. The printer is realized to substitute for the traditional seal; meanwhile, a coaxial connection device is arranged in the printer, a structure thereof is simple and has a certain tolerance for an error of the coaxiality, so that the printer is simple to install, and is firm and durable.

15 Claims, 3 Drawing Sheets

SEAL PRINTER

CROSS-REFERENCE TO RELATED APPLICATIONS

This application claims the priority of Chinese Patent Application No. 201910588837.5, entitled "NOVEL SEAL PRINTER" filed with the Chinese Patent Office on Jul. 2, 2019, which is incorporated herein by reference in its entirety.

TECHNICAL FIELD

The disclosure relates to a portable printer, and in particular to a seal printer.

BACKGROUND ART

An official seal is a seal for legal person to handle internal and external affairs, and only document with an official seal stamped thereon has legal effect. In order to improve stamping efficiency and other purposes, in recent years, a seal printing system has been developed in the prior art, which utilizes a printer to print a seal and has advantages of clear printing effect, effective labor cost, being able to cooperated with a computer system to achieve an anti-counterfeiting function, and the like. The system is increasingly widely used.

However, at present, there is no printer specially used for printing the seal. The current printer can only print documents affixed with electronic seals, that is, the seals and the documents are printed together, where the printer can print any content, and there is no monitoring and limitation on the use of the printer and the control of content to be printed. The printing product generally presents an effect of a normal printing ink, without an effect of stamping ink. Therefore, the current printing is only regarded as outputting raster image documents, but not stamping the documents.

In a word, at present, there is no special seal printing apparatus, so a dedicated seal printer which is small in size, controllable in process and capable of achieving an effect similar to actual stamping is desired. However, the existing seal printing apparatuses are mostly manufactured by using or slightly modifying a conventional printer, and such prior art printing apparatuses have the following problems in use:

1. the apparatuses occupy too much spaces, need to be connected to power wires in use, and do not have such an advantage of portability as that traditional seals have;
2. the apparatuses need to cooperate with a paper feeding mechanism, and the paper feeding mechanism must be adjusted to match with a position of a printing nozzle, so that a position at which the seal is printed is difficult to be adjusted, and the apparatuses cannot arbitrarily affix a seal at different specified positions at any time like the conventional seal;
3. a traditional parallel printing mode is mostly adopted, that is, the printing head moves in a plane along directions of two coordinate axes vertical to each other or only in one direction respectively, in such printing mode, the printing generally can be completed by a plurality of round trips, which is time-consuming, energy-consuming and ineffective; in addition, due to a structural design of a traditional printer, a traditional parallel printer has problems in that an outer edge of a printed circle is not circular enough, and when a printing nozzle transversely moves on the surface of paper, a visible error, that is a stepped pattern, appears at a joint of the current stroke and a next stroke;
4. an irregular structure of the existing ink cartridge can affect a volume of the entire printer, making a structure of the entire printer bulky and clumsy.

SUMMARY

For the above technical problems, the disclosure relates to a seal printer, which is specifically implemented by adopting the following means.

1) A rotary printing mode is adopted, wherein a motor drives a printing rotating assembly to rotate, and finally drives a ink cartridge and a nozzle therebelow to rotate and perform ink-jet printing, such rotary printing mode not only can overcome the problem that stepped patterns are easy caused when printing a round edge in the traditional parallel printing mode, but also can greatly reduce a volume to make the printer truly portable.
2) The internal structure of printer is a simple and compact, the number of parts is minimized, and meanwhile the volume is reduced as much as possible so as to achieve a same volume as that of the traditional seal, thus a convenience in use is greatly improved and a truly substitute for the traditional seal is obtained. For example, a motor support with a motor receiving groove is used to reduce the space occupied; while main control board support posts are used to support a main control board, a screw rod on a lower end thereof is also used to fix a motor support to a shell, such multifunctional use of a part also has effects of reducing the volume and overall weight.
3) The cylindrical ink cartridge is used to substitute for the traditional irregular or square ink cartridge and is mounted at a bottom of a cylindrical ink cartridge fixing frame and in the cylindrical shell. Such matching in contour maximizes the utilization rate of the volume.
4) An electric connection ring structure coaxially mounted with the motor is adopted to solve the problem about an electric connection between a main control circuit board located above a motor in a stationary state and a driving control board located below the motor in a rotating state, and an upper piece and a lower piece of the electric connection ring are electrically connected through brushes, the upper piece of the electric connection ring are stationary relative to the main control circuit board and the both are electrically connected through a wire, and the lower piece of the electric connection ring synchronously rotates with the driving control board and the both are electrically connected through a wire. Such electric connection ring structure solves the problem of an electric connection between the assembly in the stationary state and the assembly in the rotating state, and is simple and light;
5) The coaxial connection device is used to solve the problem of the coaxiality between the motor and the middle shaft during installation, and can still perform power transmission between the motor and the middle shaft even when there is a error in the coaxiality. Thus, a requirement for installation precision of the device is reduced and the device is firm and durable. Moreover, the coaxial connection device consists of only two circular pieces, and has a simple structure and light weight.
6) Between the ink cartridge and the ink cartridge fixing frame, a detachable connection structure, such as a catching slot-hook connection structure, is adopted.

Specifically, hooks are arranged around a periphery of the ink cartridge and are disconnecting from the ink cartridge fixing frame through retracting the hooks, so that the installation and the disassembly of the ink cartridge are simple and quick.

7) The shell is provided with two protruding portions which protrudes inwards, that is, a first protruding portion and a second protruding portion, which respectively form a support point for the internal printing assembly. Such two-point support structure does not require high coaxiality during installation, and implements relatively stable support, that is, such structure achieves a stable connection, and meanwhile ensures a convenience of installation, a simplicity of the structure and a minimization of the number of parts.

8) The main control circuit board is supported by a top end of the main control board support posts, and is entirely in a suspended state, and is not in contact with the motor fixing frame therebelow, which ensures as much as possible that the installation position of the electrical elements on the main control board are not influenced, and such reserved space is also convenient to replace the circuit board with circuit boards with different arrangements of electrical elements and different requirements of heat dissipation in the late.

Specifically, the disclosure adopts the following technical solutions:

a seal printer comprises a shell (17), a battery (3) positioned inside the shell, a motor (7), a printing fixing assembly and a printing rotating assembly, wherein:

the motor (7) comprises an upper portion and a lower portion, the upper portion is a stationary portion (24) which is stationary relative to the shell (17), and the lower portion is a rotated portion (27) which rotates relative to the shell (17);

the printing fixing assembly is fixedly connected with the stationary portion (24) as the upper portion of the motor (17), and the printing rotating assembly is fixedly connected with the rotated portion (27) as the lower portion of the motor (17) and is driven by the rotated portion (27) to rotate;

the printing fixing assembly comprises a motor fixing frame (5), main control board support posts (6) and a main control circuit board (4); the motor fixing frame (5) is fixedly connected with the shell through threaded portions at lower ends of the main control board support posts (6); the main control circuit board (4) is positioned above the motor fixing frame (5) and is supported and fixed by upper ends of the main control board support posts (6); the motor fixing frame (5) is fixedly connected with the stationary portion (24) of the motor (7);

the printing rotating assembly comprises a middle shaft (14), an ink cartridge fixing frame (15) and the ink cartridge (16); the middle shaft (14) is fixedly connected on its top with the rotated portion (27) of the motor (7) and on its bottom with the ink cartridge fixing frame (15), which is fixedly connected therein with the ink cartridge (16) and drives the ink cartridge to rotate, and the printing nozzle (23) is fixedly connected to the bottom of the ink cartridge (16).

Further, an electric connection ring (8) is concentrically arranged in the motor (7).

Further, the electric connection ring (8) comprises an electric connection ring housing (26) and an electric connection ring core (25) positioned in the electric connection ring housing (26), which are electrically connected to each other through brushes, the electric connection ring shell (26) is coaxially and fixedly mounted in the rotated portion (27) of the motor and is driven by the rotated portion (27) of the motor (7) to rotate synchronously with a rotation of the rotated portion (27), the electric connection ring core (25) is electrically connected to one end of a wire which extends upwards and is connected with the main control circuit board (4) at its another end, the electric connection ring housing (26) is electrically connected to one end of a wire which extends downwards and is connected with a driving control board (13) at its another end.

Further, a coaxial connection device is arranged between the rotated portion of the motor (7) and the top of the middle shaft (14).

Further, the coaxial connection device comprises a circular main piece (9) and a circular negative piece (10), the circular main piece (9) is fixedly connected with a lower end of the rotated portion (27) of the motor (7) and is formed into a disc with a plurality of protruding cylinders; the circular negative piece (10) is fixedly connected with the top of the middle shaft (14) and is formed into a plurality of elongated grooves at positions corresponding to protruding cylinders, the grooves have widths equal to or slightly larger than diameters of the respective protruding cylinders, and are formed into the elongated grooves extending by a distance along a radial direction with a circle center same as a circle center of the negative piece. Further, the middle shaft (14) is cylindrical and integrally molded with the ink cartridge fixing frame (15).

Further, the middle shaft (14) is provided at an outside thereof with a bearing (11) supported by a bearing seat (12) fixed to the shell (17).

Further, the shell (17) is provided with a first protruding portion (20) and a second protruding portion (22) which both protrude inwards; the threaded portions at lower end of the main control board support posts (6) are screwed into threaded holes in the first protruding portion (20); the bearing seat (12) is fixed to the shell (17) by screwing bolts into threaded holes (21) arranged in the second protruding portion (22).

Further, the main control board support post (6) is provided in top end thereof with recessed threaded hole groove (18), the main control circuit board (4) is fixed to the top ends of the main control board support posts (6) by screwing bolts into recessed threaded hole grooves (18).

Further, the motor fixing frame (5) is provided with a groove for receiving the motor (7)

Further, the ink cartridge fixing frame (15) is provided with a plurality of catching slots along a periphery thereof, which are engaged with hooks at corresponding positions of the ink cartridge (16).

Further, the ink cartridge (16) is a cylindrical.

Further, the main control circuit board (4) is not in contact with the motor fixing frame (5).

Further, the shell (17) has a top cover (2), on which is fixed with a fingerprint module (1).

DETAILED DESCRIPTION OF THE EMBODIMENTS

In order to make objects, technical solutions and advantages of the present disclosure more apparent, the technical solutions of the present disclosure will be clearly and completely described below with reference to the accompanying drawings, and it is obvious that the described embodiments are some, but not all embodiments of the present disclosure. All other embodiments obtained by person skilled in the art based on the embodiments of the present disclosure without inventive labors shall fall within the protection scope of the present disclosure.

Figure 1:
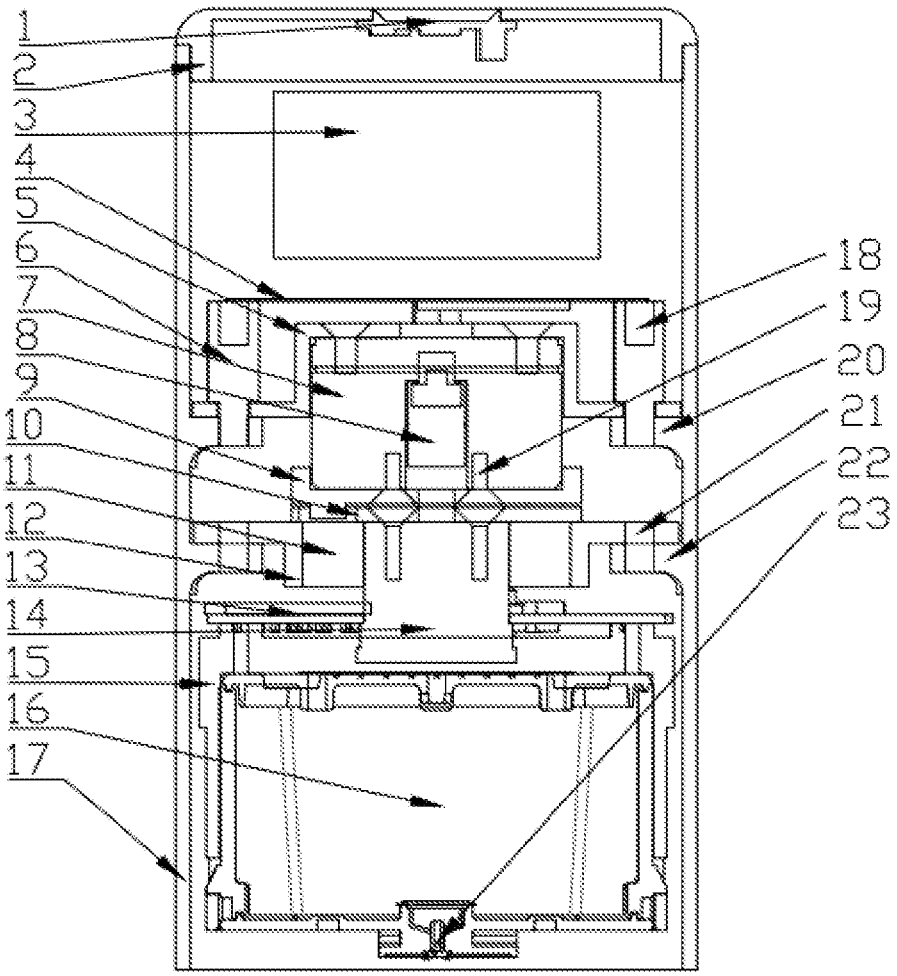
FIG. 1 is an assembly view of a handheld printer of the present disclosure.

FIG. 1 is an assembly view of a handheld printer of the present disclosure, wherein the printer has a shell 17, an openable top cover 2 is mounted on a top of the shell 17, a fingerprint module 1 is mounted on the top cover 2 at a substantially central position thereof so as to correspond to a position of a thumb when one's hand holding the printer, to capture a fingerprint. The battery 3 is mounted in such a way that after the top cover is opened, the battery 3 therein can be seen, so as to be convenient to be taken out and replaced, and to supply power for a main control circuit board 4.

A motor fixing frame 5 is arranged below the battery, and is integrally shaped as a π pattern. The motor fixing frame 5 is mounted, at an edge thereof, on a first protruding portion 20 protruding from the shell towards an inner side, through four support legs of the motor fixing frames, and is fixed by screwing screw rods formed at main control panel support posts 6 into respective threaded holes of the first protruding portion 20.

The main control board support posts 6 are provided in their upper ends with recessed threaded hole grooves 18. The main control circuit board 4 is supported by the upper ends of the four main control board support posts 6, and is fixed by screwing bolts into the recessed threaded hole grooves 18. At this time, the main control circuit board 4 is supported by the upper ends of the four main control board support posts 6 to form a suspended state, and the main control circuit board 4 is separated from the motor fixing frame 5 therebelow by a distance.

Figure 6:
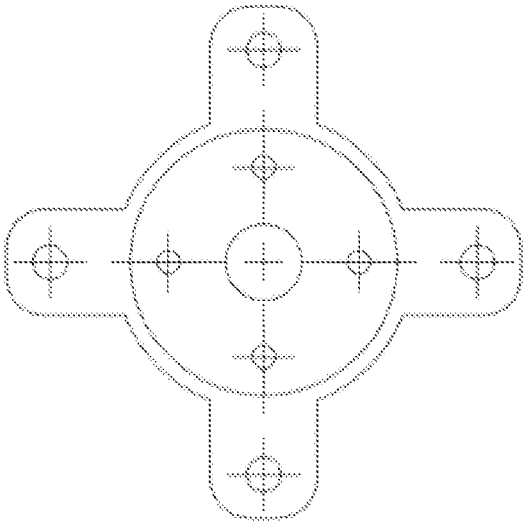
FIG. 6 is a bottom view of a structure of a motor fixing frame of the present disclosure.

FIG. 6 is a bottom view of the motor fixing frame 5 of the present disclosure and a middle portion of the motor fixing frame forms a cylindrical receiving groove for a motor 7, which just receives the cylindrical motor 7 therein. The motor fixing frame 5 and a top of the motor 7 are fixedly connected with each other by thread.

Figure 2:
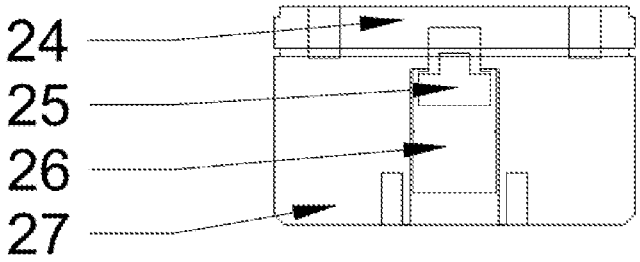
FIG. 2 is a schematic view of a motor and an electrical connection ring installed therein of the present disclosure.

FIG. 2 is an assembly view of the motor and an electrical connection ring installed therein of the present disclosure, wherein the motor includes an upper stationary portion 24 and a lower rotating portion 27, and the stationary portion is stationary with respect to the shell 17 due to a connection between the stationary portion and the motor fixing frame 5. The rotated portion 27 is arranged below the motor 7 and the electric connection ring 8 is fixedly arranged in the rotated portion in a manner of interference fit, bonding or the like. The electric connection ring comprises a housing 26 and an electric connection ring core 25 positioned inside the housing 26, which are contacted with each other and mutually supported, and can rotate relative to each other by means of internal bearings or the like. Meanwhile, the housing 26 and the electric connection ring core 25 can be electrically connected with each other by means of an electric brush or the like. Furthermore, the electric connection ring core 25 is connected to one end of a wire which extends upward and is connected with the main control circuit board 4 at another end, and the housing 26 is connected to one end of a wire which extends downward and is connected with a driving control board 13 at another end. The above-mentioned configuration of the electrical connection ring finally achieves a stable electrical connection between the stationary main control circuit board 4 and the rotated driving control board 13.

Figure 3:
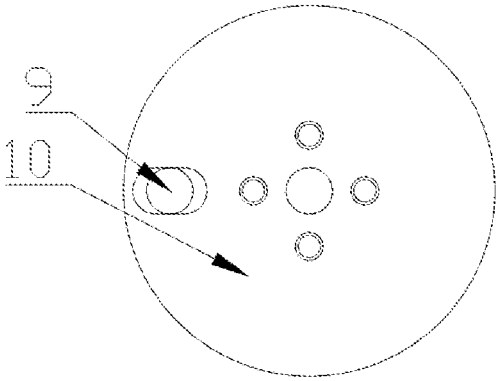
FIG. 3 is a bottom view of a coaxial connection device of the present disclosure in an assembled state.
Figure 4:
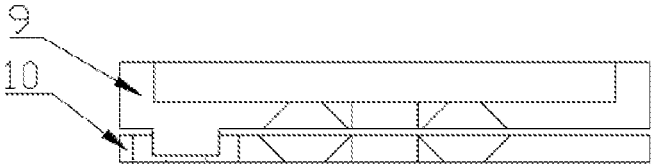
FIG. 4 is a side view of the coaxial connection device of the present disclosure in the assembled state.

A circular main piece 9 of a coaxial connection device is connected to a bottom of the motor rotated portion 27 through a bolt 19, the circular main piece matches and is connected with the circular negative piece 10, as shown in FIGS. 3 and 4. The circular main piece is provided with a plurality of cylinders protruding from a side surface of the circular main piece. The cylinders are inserted into elongated grooves at corresponding positions of the circular negative piece 10 as shown in FIG. 3. The elongated grooves extend by a distance along a radial direction of the round negative film 10 and each has groove width which is equal to or slightly larger than a diameter of the core cylinder on the circular main piece 9. As shown in FIG. 3, the coaxial connection device composed of the circular main piece 9 and the circular negative piece 10 has a certain tolerance for an error of a coaxiality for rotated bodies mounted to top and bottom thereof. That is, when an error occurs in the coaxiality of the rotated portion 27 of the motor 7 and the central shaft 14 , a normal force transmission process from the motor 7 to the middle shaft 14 is still able to be achieved so as to ensure a normal operation of the device.

The middle shaft 14 is a internal hollow cylindrical component. A top end of the middle shaft is closed, and is fixedly connected with the circular negative piece 10 of the coaxial connection device through bolts 19. The middle shaft 14 can be integrally molded with an ink cartridge fixing frame 15 located below the middle shaft 14.

The middle shaft 14 is provided on an outside thereof with a bearing 11 for enabling the middle shaft to be rotated, and the bearing 11 is provided on an outside with a bearing seat 12 for supporting the bearing, wherein the bearing seat 12 is fixedly mounted on a second protruding portion 22 protruding inwards from the shell 17 through bolts 21.

Figure 5:
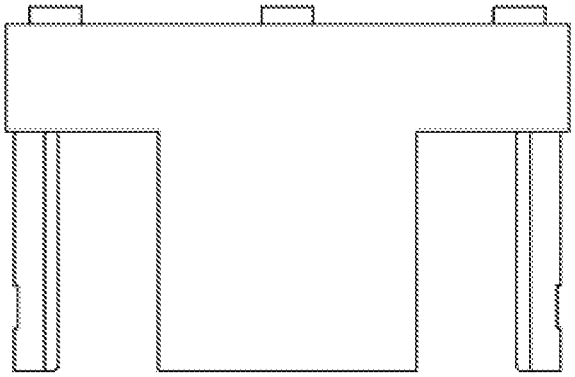
FIG. 5 is a schematic view of a structure of an ink cartridge support of the present disclosure.

The ink cartridge fixing frame 15 has a structure as shown in FIG. 5, is formed with an receiving cavity therein for receiving an ink cartridge 16, and has catching slots disposed on side plates of the ink cartridge fixing frame, and the catching slots cooperate with hooks located at corresponding positions of the ink cartridge 16 to lock. The ink cartridge 16 is integrally provided on its bottom with a nozzle 23, on which a plurality of ink jetting holes arranged in a matrix form are disposed, and when the nozzle rotates along with the ink cartridge 16, through the ink jetting holes arranged in a matrix form, ink is ejected according to a certain algorithm so as to print seal patterns of circle or other shapes.

The structure of the printer of the present disclosure is described in detail above, and the operation thereof is described below.

When the printer is used, the fingerprint module 1 is touched by a finger, that is, a command for starting printing is sent to the printer, the main control circuit board 4 is powered by the battery 3 and electrically connected with the driving control board 3 to control the process of the nozzle 23 ejecting the ink.; the main control circuit board is simultaneously electrically connected with the motor 7 to control a rotation speed of the upper rotated portion 27 of the motor 7; the main control circuit board 7 controls the nozzle 23 to print seals of different contents by matching the rotation speed of the rotated portion 27 with a timing for ejecting the ink and a time period for ejecting the ink in the nozzle 23.

The above is a further detailed description of the present disclosure in combination with specific preferred embodiments. It cannot be considered that the present disclosure be limited to these embodiments. Those skilled in the art can make some simple deductions or replacements without departing from the spirit of the disclosure, and such amendments should be construed as falling within the scope of the disclosure defined by the appended claims.

What is claimed is:

1. A seal printer comprising a shell, a battery positioned inside the shell, a motor, a printing fixing assembly and a printing rotating assembly, wherein:

the printing fixing assembly is a portion of a printer assembly fixed or stationary relative to the shell; the printing rotating assembly is a portion of the printer assembly rotated relative to the shell, the motor comprises an upper portion and a lower portion, the upper portion is a stationary portion which is stationary relative to the shell, and the lower portion is a rotated portion which rotates relative to the shell;

the printing fixing assembly is fixedly connected with the stationary portion as the upper portion of the motor, and the printing rotating assembly is fixedly connected with the rotated portion as the lower portion of the motor and is driven by the rotated portion to rotate;

the printing rotating assembly comprises an ink cartridge and a printing nozzle fixedly connected to a bottom of the ink cartridge.

2. The seal printer of claim 1, wherein the printing fixing assembly comprises a motor fixing frame, main control board support posts and a main control circuit board; the motor fixing frame is fixedly connected with the shell through threaded portions at lower ends of the main control board support posts; the main control circuit board is positioned above the motor fixing frame and is supported and fixed by upper ends of the main control board support posts; the motor fixing frame is fixedly connected with the stationary portion of the motor;

the printing rotating assembly comprises a middle shaft, an ink cartridge fixing frame and the ink cartridge; the middle shaft is fixedly connected on its top with the rotated portion of the motor and on its bottom with the ink cartridge fixing frame, which is fixedly connected therein with the ink cartridge and drives the ink cartridge to rotate, and the printing nozzle is fixedly connected to the bottom of the ink cartridge.

3. The seal printer of claim 1, wherein an electric connection ring is concentrically arranged in the motor.

4. The seal printer of claim 2, wherein the electric connection ring comprises an electric connection ring housing and an electric connection ring core positioned in the electric connection ring housing, which are electrically connected to each other through brushes, the electric connection ring housing is coaxially and fixedly mounted in the rotated portion of the motor and is driven by the rotated portion of the motor to rotate synchronously with a rotation of the rotated portion, the electric connection ring core is electrically connected to one end of a wire which extends upwards and is connected with the main control circuit board at its another end, the electric connection ring housing is electrically connected to one end of a wire which extends downwards and is connected with a driving control board at its another end.

5. The seal printer of claim 2, wherein a coaxial connection device is arranged between the rotated portion of the motor and the top of the middle shaft.

6. The seal printer of claim 4, wherein the coaxial connection device comprises a circular main piece and a circular negative piece, the circular main piece is fixedly connected with a lower end of the rotated portion of the motor and is formed into a disc with a plurality of protruding cylinders; the circular negative piece is fixedly connected with the top of the middle shaft and is formed with a plurality of elongated grooves at positions corresponding to protruding cylinders, the grooves have widths equal to or slightly larger than diameters of the respective protruding cylinders, and are formed into the elongated grooves extending by a distance along a radial direction with a circle center same as a circle center of the negative piece.

7. The seal printer of claim 2, wherein the middle shaft is cylindrical and integrally molded with the ink cartridge fixing frame.

8. The seal printer of claim 2, wherein the middle shaft is provided at an outside thereof with a bearing supported by a bearing seat fixed to the shell.

9. The seal printer of claim 7, wherein the shell is provided with a first protruding portion and a second protruding portion which both protrude inwards; the threaded portions at lower end of the main control board support posts are screwed into threaded holes in the first protruding portion; the bearing seat is fixed to the shell by screwing bolts into threaded holes arranged in the second protruding portion.

10. The seal printer of claim 2, wherein the main control board support post is provided in top end thereof with recessed threaded hole groove, the main control circuit board is fixed to the top ends of the main control board support posts by screwing bolts into the recessed threaded hole grooves.

11. The seal printer of claim 2, wherein the motor fixing frame is provided with a groove for recieving the motor.

12. The seal printer of claim 2, wherein the ink cartridge fixing frame is provided with a plurality of catching slots along a periphery thereof, which are engaged with hooks at corresponding positions of the ink cartridge.

13. The seal printer of claim 2, wherein the ink cartridge is a cylindrical.

14. The seal printer of claim 2, wherein the main control circuit board is not in contact with the motor fixing frame.

15. The seal printer of claim 2, wherein the shell has a top cover, on which is fixed with a fingerprint module.

* * * * *